US010001010B2

(12) United States Patent
Bergmann

(10) Patent No.: US 10,001,010 B2
(45) Date of Patent: Jun. 19, 2018

(54) AXIAL PISTON MACHINE UTILIZING A BENT-AXIS CONSTRUCTION WITH SLIPPERS ON THE DRIVE FLANGE

(71) Applicant: Linde Hydraulics GmbH & CO. KG, Aschaffenburg (DE)

(72) Inventor: Martin Bergmann, Schaafheim (DE)

(73) Assignee: Linde Hydraulics GmbH & Co. KG, Aschaffenburg (DE)

( * ) Notice: Subject to any disclaimer, the term of this patent is extended or adjusted under 35 U.S.C. 154(b) by 458 days.

(21) Appl. No.: 14/674,189

(22) Filed: Mar. 31, 2015

(65) Prior Publication Data

US 2015/0285076 A1 Oct. 8, 2015

(30) Foreign Application Priority Data

Apr. 8, 2014 (DE) ..... 10 2014 104 952

(51) Int. Cl.
*F01B 3/00* (2006.01)
*F03C 1/06* (2006.01)
(Continued)

(52) U.S. Cl.
CPC ..... *F01B 3/0002* (2013.01); *F01B 3/0082* (2013.01); *F03C 1/0665* (2013.01);
(Continued)

(58) Field of Classification Search
CPC ..... F01B 3/0002; F01B 3/0082; F01B 9/04; F03C 1/0649; F03C 1/0665; F03C 1/0668;
(Continued)

(56) References Cited

U.S. PATENT DOCUMENTS 3,198,130 A 8/1965 Thoma
3,827,337 A 8/1974 Pruvot
(Continued)

FOREIGN PATENT DOCUMENTS

DE 3725979 A1 3/1988
DE 10154921 A1 5/2003
EP 2050957 A1 8/2008

*Primary Examiner* — Logan Kraft
(74) *Attorney, Agent, or Firm* — The Webb Law Firm

(57) ABSTRACT

A hydrostatic axial piston machine (1) utilizing a bent-axis construction has a driveshaft (4) with a drive flange (3) rotatable around an axis of rotation ($R_t$) inside a housing (2). A cylinder barrel (7) has pistons (10) fastened in an articulated manner to the drive flange (3). The drive flange (3) is supported on a housing-side slide face (101) by an axial bearing (100) in the form of a hydrostatically relieved sliding bearing (102) having a plurality of slippers (105). Each of the slippers (105) is mounted in an articulated manner in the drive flange (3) so that when the drive flange (3) rotates, a compensating force ($F_{FR}$) acts on the slipper (105) which is in the opposite direction to the centrifugal force ($F_F$) acting on the slipper (105). The point of application (AP) of the compensating force ($F_{FR}$) on the slipper (105) is selected so that there is no tipping moment on the slipper (105) or to compensate for some or all of any tipping moment that does occur.

24 Claims, 7 Drawing Sheets

(51) Int. Cl.
*F04B 1/20* (2006.01)
*F04B 1/12* (2006.01)

(52) U.S. Cl.
CPC ..... *F03C 1/0668* (2013.01); *F03C 1/0671* (2013.01); *F04B 1/126* (2013.01); *F04B 1/2071* (2013.01); *F04B 1/2078* (2013.01); *F04B 1/2085* (2013.01); *F04B 1/2092* (2013.01); *F04C 2240/54* (2013.01)

(58) Field of Classification Search
CPC ..... F03C 1/0671; F04B 1/122; F04B 1/126; F04B 1/2007; F04B 1/2028; F04B 1/2071; F04B 1/2078; F04B 1/2085; F04B 1/2092; F04B 2201/1207; F04B 2201/1209; F04B 2201/1212; F04C 2240/50; F04C 2240/54
See application file for complete search history.

(56) References Cited

U.S. PATENT DOCUMENTS

| | | | | |
|---|---|---|---|---|
| 4,546,692 | A * | 10/1985 | Lotter ..... | F04B 1/2028 384/121 |
| 4,872,394 | A | 10/1989 | Nakagawa et al. | |
| 5,381,724 | A | 1/1995 | Kawahara et al. | |
| 2009/0095149 | A1 | 4/2009 | Bergmann | |

* cited by examiner

AXIAL PISTON MACHINE UTILIZING A BENT-AXIS CONSTRUCTION WITH SLIPPERS ON THE DRIVE FLANGE

CROSS REFERENCE TO RELATED APPLICATIONS

This application claims priority to German Application No. DE 102014104952.7 filed Apr. 8, 2014, which is herein incorporated by reference in its entirety.

BACKGROUND OF THE INVENTION

Field of the Invention

This invention relates to a hydrostatic axial piston machine utilizing a bent-axis construction having a driveshaft with a drive flange located inside a housing and rotatable around an axis of rotation. A cylinder barrel is located inside the housing and is rotatable around an axis of rotation. The cylinder barrel includes a plurality of piston bores. A longitudinally displaceable piston is located in each piston bore. The pistons are fastened to the drive flange in an articulated manner. The drive flange is supported on a housing-side slide face by an axial bearing that is in the form of a hydrostatically relieved sliding bearing having a plurality of slippers, each of which is mounted in an articulated manner on the drive flange, and each of which is provided on the end surface facing the slide face with a pressure pocket in communication with an associated displacement chamber of the axial piston machine for the supply with hydraulic fluid.

Description of Related Art

In hydrostatic axial piston machines utilizing a bent-axis construction, the longitudinally displaceable pistons located in the cylinder barrel are generally fastened to the drive flange of the driveshaft by a ball joint. The piston forces are transmitted by the piston to the drive flange located on the driveshaft and generate a torque.

Generic axial piston machines employing a bent-axis construction have significantly higher maximum allowable speeds of rotation than axial piston machines utilizing a swashplate construction, so that axial piston machines utilizing a bent-axis construction have advantages for use as a hydraulic motor.

In axial piston machines utilizing a bent-axis construction, the axial forces resulting from the piston forces can be supported by means of the drive flange and the driveshaft with a roller bearing. An axial piston machine of this type utilizing a bent-axis construction is illustrated, in FIG. 5 of DE 101 54 921 A1. The roller bearing of the driveshaft is formed by tapered roller bearings arranged in pairs. On account of the high axial forces to be absorbed, these two tapered roller bearings are correspondingly large to achieve a sufficiently long useful life. However, large bearings of this type occupy a great deal of space and, on account of the high inertial forces that occur, limit the maximum allowable speed of rotation of the axial piston machine.

To overcome these disadvantages, the axial forces in axial piston machines utilizing a bent-axis construction can be relieved by an axial bearing in the form of a hydrostatically relieved sliding bearing on a housing-side slide face. As a result of the hydrostatic relief of the axial forces, the roller bearing system of the driveshaft and of the drive flange can be made smaller and the limit speed of rotation of the axial piston machine can be increased on account of the lower inertial forces.

For the design of a hydrostatically relieved sliding bearing as an axial bearing, pressure pockets can be formed in one axial end surface of the drive flange with which the drive flange is in contact with a housing-side slide face, which pressure pockets are in communication with the displacement chambers for the supply of hydraulic fluid. To achieve a contact of the drive flange on the housing-side slide face that forms a sealing surface for the pressure pockets, the drive flange is in the form of a component that is separate from the driveshaft and is movable in the axial direction relative to the driveshaft. By means of a torque connection, such as a spline gearing, the drive flange is connected torque-tight with the driveshaft. Axial piston machines of this type are known, for example, from FIGS. 3 in DE 101 54 921 A1, U.S. Pat. No. 4,872,394 A1 and U.S. Pat. No. 3,827,337 A1. In axial piston machines of this type utilizing a bent-axis construction, there is no tipping of the drive flange away from the housing-side slide face at high speeds of rotation. Tipping of this type leads to an opening of the seal gap on the hydrostatically relieved sliding bearing and to a resulting increased loss of hydraulic fluid by leakage on the hydrostatic sliding bearing. One disadvantage of these axial piston machines, however, is that the torque connection necessary for the transmission of torque between the drive flange and the driveshaft entails a great deal of extra construction effort and expense and is complicated to manufacture. On account of the high stresses and loads that occur in the torque connection, which can be in the form of a spline shaft gearing, the maximum torque that can be transmitted at the torque connection, which equals the output torque of the axial piston machine, is limited. In addition, on account of the drive flange that is provided with pressure pockets, it is not possible to compensate for irregularities in the housing-side sealing surface that result from component deformations as a result of the pressure applied.

For the design of a hydrostatically relieved sliding bearing in the form of an axial bearing, it is possible in axial piston machines utilizing a bent-axis construction to locate longitudinally movable slippers in the drive flange that are in contact with the housing-side slide face and are provided with a pressure pocket which is in communication with an associated displacement chamber for the supply of hydraulic fluid. Axial piston machines utilizing a bent-axis construction of this type, in which the axial forces are hydrostatically relieved by means of slippers that are located between the drive flange and the housing, are known from FIGS. 1 and 4 in DE 101 54 921 A1, U.S. Pat. No. 3,198,130 A1, and U.S. Pat. No. 4,546,692 A1. With a hydrostatic sliding bearing of this type using slippers, the drive flange and the driveshaft can be constructed as a single piece so that there is no need for a strength-critical connection between the drive flange and the driveshaft. To ensure that the axial sealing faces of the sliding bearing (formed by the housing-side slide face and the end surface of the slipper) can be properly aligned and oriented with respect to each other to form an effective seal, it is necessary to mount the slipper in the drive flange in an articulated manner and so that it is longitudinally displaceable. An articulated bearing system for the slipper in the drive flange is necessary because a correct orientation of the drive flange with respect to the housing-side slide face is not possible on account of manufacturing tolerances and the deformations that occur during operation of the axial piston machine. Partial compensation for irregularities on the housing-side slide face that occur as a result of component deformations under the applied pressure can also be achieved by the articulated bearing system of the slippers in the drive flange and thus an installation of the slippers in the drive flange in which they are capable of executing a tipping movement. However, one disadvantage with axial piston machines of this type utilizing a bent-axis construction is that at high speeds of rotation, as a result of the strong centrifugal force acting radially outwardly, in connection with the articulated connection of the slippers in the drive flange, the slippers can tip away from the housing-side slide face. Increased leakage can occur at the hydrostatically relieved sliding bearing that reduces the efficiency of the axial piston machine. The maximum allowable speed of rotation is therefore limited on account of the leakage losses that occur as a result of the tipping slippers.

SUMMARY OF THE INVENTION

An object of this invention is to provide an axial piston machine of the general type described above utilizing a bent-axis construction with a hydrostatic relief of the axial forces by slippers mounted in an articulated manner in the drive flange that can be operated at high speeds of rotation and simultaneously has a high degree of efficiency.

This object is accomplished in that the slippers are each mounted in an articulated manner in the drive flange so that when the drive flange is rotating, a compensating force acts on the slipper that is in the opposite direction to the centrifugal force acting on the slipper. The point of application of the compensating force on the slipper is selected so that no tipping moment occurs on the slipper, or to compensate for some or all of any tipping moment that does occur. At high speeds of rotation of the axial piston machine, on account of the mass of the slipper, a centrifugal force that is directed radially outwardly occurs that acts on the center of gravity of the slipper. The invention teaches that a compensating force that acts on the slipper, and is in the opposite direction to the centrifugal force generated, is applied to the slipper so that no tipping moment occurs on the slipper or to compensate for some or all of any tipping moment that does occur. In the axial piston machine of the invention, the compensating force can prevent a tipping of the slipper away from the housing-side slide face that would be caused by the centrifugal force acting on the slipper so that the axial piston machine can be operated at high speeds of rotation without tipping of the slippers. Even at high speeds of rotation, an increase in leakage at the hydrostatically relieved sliding bearing between the slippers and the housing-side slide face can be prevented and the axial piston machine can be operated with high efficiency at high speeds of rotation.

In one advantageous embodiment of the invention, the point of application of the compensating force in the axial direction is at the level of the center of gravity of the slipper.

Consequently, the centrifugal force and the compensating force act in directly opposite directions so that no tipping moment occurs on the slipper.

In one preferred embodiment of the invention, the slipper is mounted in an articulated manner in a recess in the drive flange. The radial support point of the slipper in the recess in the drive flange corresponds to the point of application of the compensating force. The compensating force is applied to the radial support point of the slipper in the recess, at which the centrifugal force of the slipper is supported.

In one advantageous embodiment of the invention, the radial support point of the slipper lies in the recess of the drive flange in a plane that is oriented perpendicularly to the axis of rotation of the drive flange and is located in the axial direction in the vicinity of the center of gravity of the slipper. The plane preferably runs in the axial direction through the center of gravity of the slipper. At the radial support point of the slipper in the recess, the support of the centrifugal force exerted on the slipper is provided by the compensating force exerted in the opposite direction. If the radial support point of the slipper in the recess of the drive flange (and, thus, the point of application of the compensating force on the slipper) lies in a plane that is oriented perpendicular to the axis of rotation of the drive flange and runs in the axial direction through the center of gravity of the slipper, the centrifugal force and the opposite compensating force directly counteract each other and have the same lines of action, so that no lever arm is formed and no tipping moment is exerted on the slipper by the centrifugal force. With a position of this type of the pair of forces formed by the centrifugal force and the compensating force, it is achieved in a simple manner that no tipping moment caused by the centrifugal force occurs on the slipper, so that with little extra construction effort or expense, a tipping of the slipper away from the housing-side slide face can be prevented at high speeds of rotation.

In one alternative embodiment of the invention, the slipper is mounted in an articulated manner in a recess in the drive flange. The radial support point of the slipper in the recess in the drive flange is at a distance from the point of application of the compensating force in the axial direction. As a result of this position of the point of application of the compensating force, compensation can be provided in a simple manner for any tipping moment that does occur on the slipper as a result of the centrifugal force to prevent a tipping of the slipper away from the housing-side slide face.

In one alternative embodiment of the invention, the slipper is in an operative connection with a compensating body that compensates in whole or in part for a tipping moment on the slipper caused by centrifugal force. With additional compensating bodies that are in an operative connection with the slippers and that compensate in whole or in part for any tipping moment on the slippers that occurs as the result of centrifugal force, it is also possible, with little additional construction effort or expense, to prevent the slippers from tipping away from the housing-side slide face at high speeds of rotation.

In one advantageous embodiment of the invention, the compensation body generates the compensation force that acts on the slipper. The compensation force is in the opposite direction to the centrifugal force acting on the slipper. The point of application of the compensating force generated by the compensating body and acting on the slipper lies in the vicinity of the center of gravity of the slipper. The point of application preferably lies in the center of gravity of the slipper. Consequently, the compensating force generated by the compensating body, like the centrifugal force, is applied to the center of gravity of the slipper, so that the centrifugal force and the compensating force in the direction opposite to the centrifugal force have identical and directly opposite lines of action, so that the centrifugal force and any tipping moment that may be applied to the slipper can be compensated for by the compensating force generated by the compensating body with little extra construction effort or expense.

As a result of the compensation for the potential tipping moment, the slipper can be mounted in an articulated manner in a recess of the drive flange so that the radial support point of the slipper in the recess of the drive flange is kept at a distance in the axial direction from the center of gravity of the slipper by a first lever arm.

In one advantageous embodiment of the invention, the compensating body is mounted in an articulated manner on the drive flange by an articulated joint and is in an operative connection with the slipper in the axial direction in the vicinity of the center of gravity of the slipper. The compensating force is generated by the centrifugal force acting on the compensating body. The compensating force acting on the slipper in the opposite direction to the centrifugal force is generated by the centrifugal force acting on the compensating body. On account of an articulated mounting of the compensating bodies in the drive flange, with little extra construction effort or expense it is possible to achieve a reversal of the direction of force, so that from the centrifugal force of the compensating body that is directed radially outwardly, a compensating force that is directed radially inwardly can be generated, i.e., a force that is in the opposite direction to the centrifugal force on the slipper.

The reversal of the direction of force can be achieved with particularly little extra construction effort if the articulated joint of the compensating body is located on the drive flange in the axial direction between the center of gravity of the slipper and the center of gravity of the compensating body. A compensating force directed radially inwardly and acting on the center of gravity of the slipper can be generated in a simple manner from the centrifugal force acting radially outwardly on the center of gravity of the compensating body by this selection of the articulated joint and thus of the support point of the compensating body in the drive flange.

The articulated connection of the compensating body with the drive flange is kept at a distance from the center of gravity of the compensating body by a second lever arm. In one preferred embodiment of the invention, the masses of the compensating body, of the first lever arm, and of the second lever arm, are designed so that the compensating force generated by the compensating body is essentially of the same magnitude as the centrifugal force acting on the slipper. By means of an appropriate design, full or almost full compensation for the tipping moment caused by centrifugal force on the slipper can be provided by the compensating body, to prevent a tipping of the slipper away from the housing-side slide face caused by centrifugal force.

The compensating body can be located radially outside the slipper and from outside can generate the compensating force that acts on the slipper in the center of gravity of the slipper. With regard to the conservation of space, it is advantageous if the compensating body is oriented coaxially with the slipper and is located inside the radial dimensions of the slipper in the drive flange.

In one advantageous development of the invention, to hold the compensating body in the drive flange, the drive flange is provided with an additional recess in which the compensating body is mounted in an articulated manner. The additional recess is oriented coaxially with the recess for the slipper.

It is particularly advantageous if the additional recess is in an operative connection with the displacement chamber and the compensating body is provided with a connecting channel, by means of which the pressure pocket of the slipper is in communication with the displacement chamber. It thereby becomes possible in a simple manner to pressurize the pressure pocket of the slipper with hydraulic fluid from the displacement chamber.

In one preferred embodiment of the invention, for the articulated mounting of the slipper in the recess of the drive flange, and thus to compensate for the tipping of the slipper in the recess of the drive flange, the slipper is located in the recess of the drive flange with some rim diametric clearance. With an appropriately dimensioned rim diametric clearance between the inside surface of the recess and the outside surface of the slipper, it becomes possible in a simple manner and with little extra construction effort or expense to achieve an articulated mounting of the slipper in the recess and a compensation for tipping of the slipper in the recess.

In one advantageous development of the invention, the slipper is provided with an increased (widened) diameter in the vicinity of the radial support point. With a corresponding increase in the diameter on the slipper, the radial support point of the slipper in the recess can be formed in a simple manner and with little extra construction effort or expense and thus a defined point of application for the compensating force can be provided.

In one advantageous embodiment of the invention, the radial outer area of the widened diameter is in the form of a spherical surface, the center point of which lies in the center of gravity of the slipper. When the area of the radial support of the slipper in the recess is in the form of a spherical partial surface on the wider-diameter portion of the slipper, the result is a particularly effective compensation for any tipping of the slipper in the recess of the drive flange.

In one alternative embodiment of the invention, the radially outer surface area of the portion with the wider diameter is an annular surface. When the area of the radial support of the slipper in the recess is in the form of an annular partial surface on the wider-diameter portion of the slipper, little extra construction effort or expense is necessary to achieve compensation for tipping of the slipper in the recess of the drive flange.

In one alternative embodiment of the invention, the radially outer surface area of the portion with the wider diameter is a cylindrical surface. A rim diametric clearance is provided between the cylindrical surface and the recess of the drive flange. When the area of the radial support of the slipper in the recess is in the form of a cylindrical partial surface on the wider-diameter portion of the slipper, in connection with a corresponding rim diametric clearance between the cylindrical surface in the wider-diameter portion and the internal surface of the recess, it is possible with little extra construction effort to compensate for tipping of the slipper in the recess of the drive flange.

In one advantageous development of the invention, a spring device is provided that pushes the slipper toward the housing-side slide face. With a spring device, is possible in a simple manner to achieve a base pressure of the slippers against the housing-side slide face.

Between the drive flange and the slipper there is advantageously a pressure chamber that is in communication with the displacement chamber. This arrangement makes it possible in a simple manner to achieve a pressure-dependent pressing of the slipper against the housing-side slide face. As a result of the presence of the pressure pocket, which is also in communication with the displacement chamber, the pressure of the slide face of the slipper against the housing-side slide face is partly relieved so that an additional hydrostatic application force acts on the slipper.

It is particularly advantageous if, as in one advantageous development of the invention, the slipper is sealed by a sealing device with respect to the pressure chamber. With a sealing device, leakage of hydraulic fluid from the pressure chamber formed between the drive flange and the slipper can be reduced, which also has advantages with regard to high efficiency of the axial piston machine.

For the location of the sealing device, little extra construction effort or expense is necessary if, as in one advantageous embodiment of the invention, the slipper is provided with a groove-shaped recess in which the sealing device, such as an O-ring, is located.

When the axial piston machine is constructed with compensating bodies on the slippers, a communication between the pressure chamber pressing the slipper and the displacement chamber can be achieved with little extra construction effort or expense if, in the vicinity of the articulated connection of the compensating bodies, there is at least one recess, by means of which the pressure chamber can be placed in connection with the displacement chamber.

In the axial piston machine, the drive flange and the driveshaft can be formed by separate components that are positively or non-positively connected to each other. This design can result in advantages in the manufacture of these two components. In one advantageous embodiment of the axial piston machine, the drive flange is formed in a single piece with the driveshaft so that the axial piston machine can be operated at high speeds of rotation and can transmit a high torque.

BRIEF DESCRIPTION OF THE DRAWINGS

Additional advantages and details of the invention are explained in greater detail below with reference to the exemplary embodiments illustrated in the accompanying schematic figures, in which like reference numbers identify like parts throughout.

DESCRIPTION OF THE PREFERRED EMBODIMENTS

Figure 1:
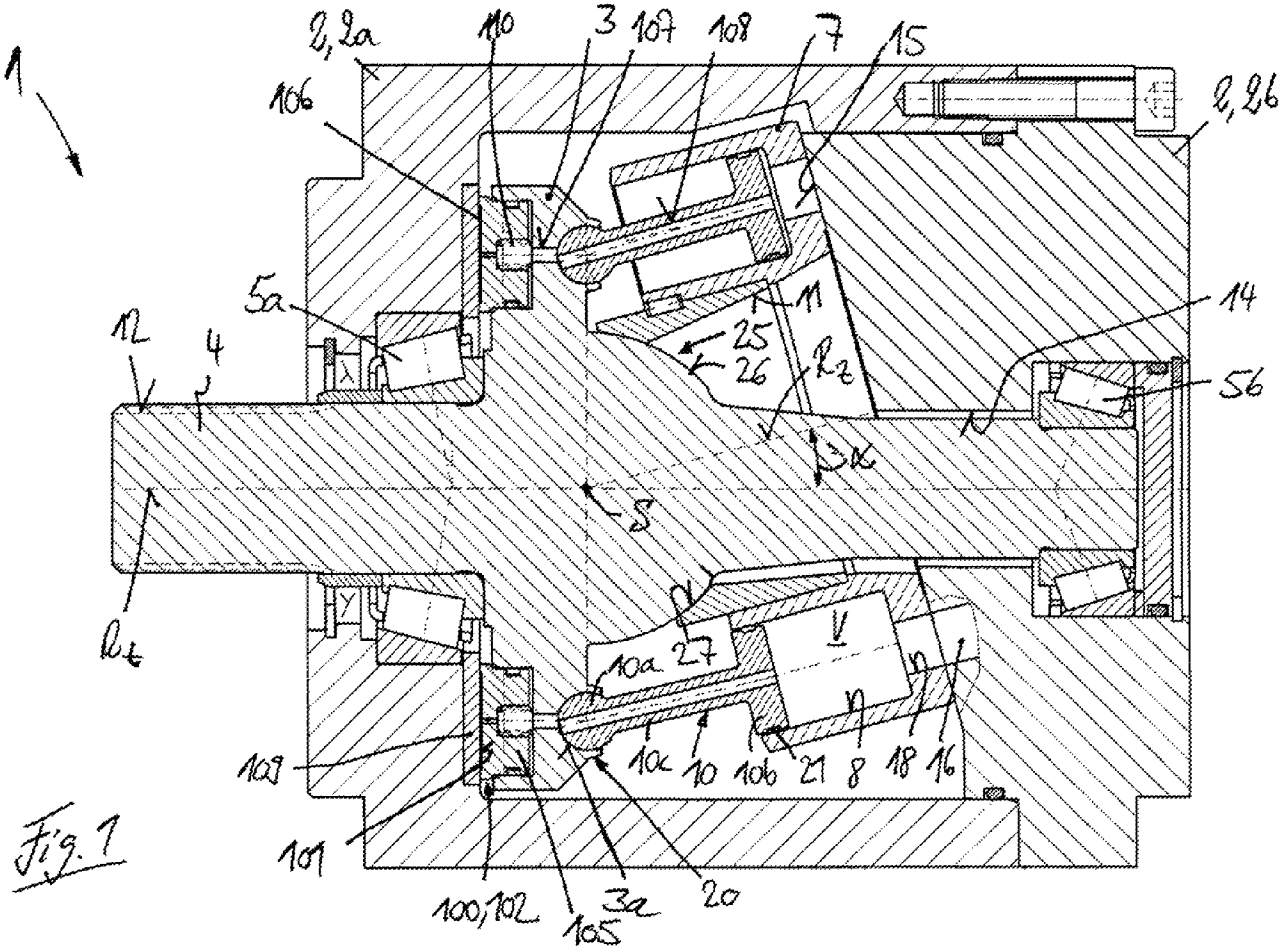
FIG. 1 is a longitudinal section through an axial piston machine of the invention employing a bent-axis construction.
Figure 2:
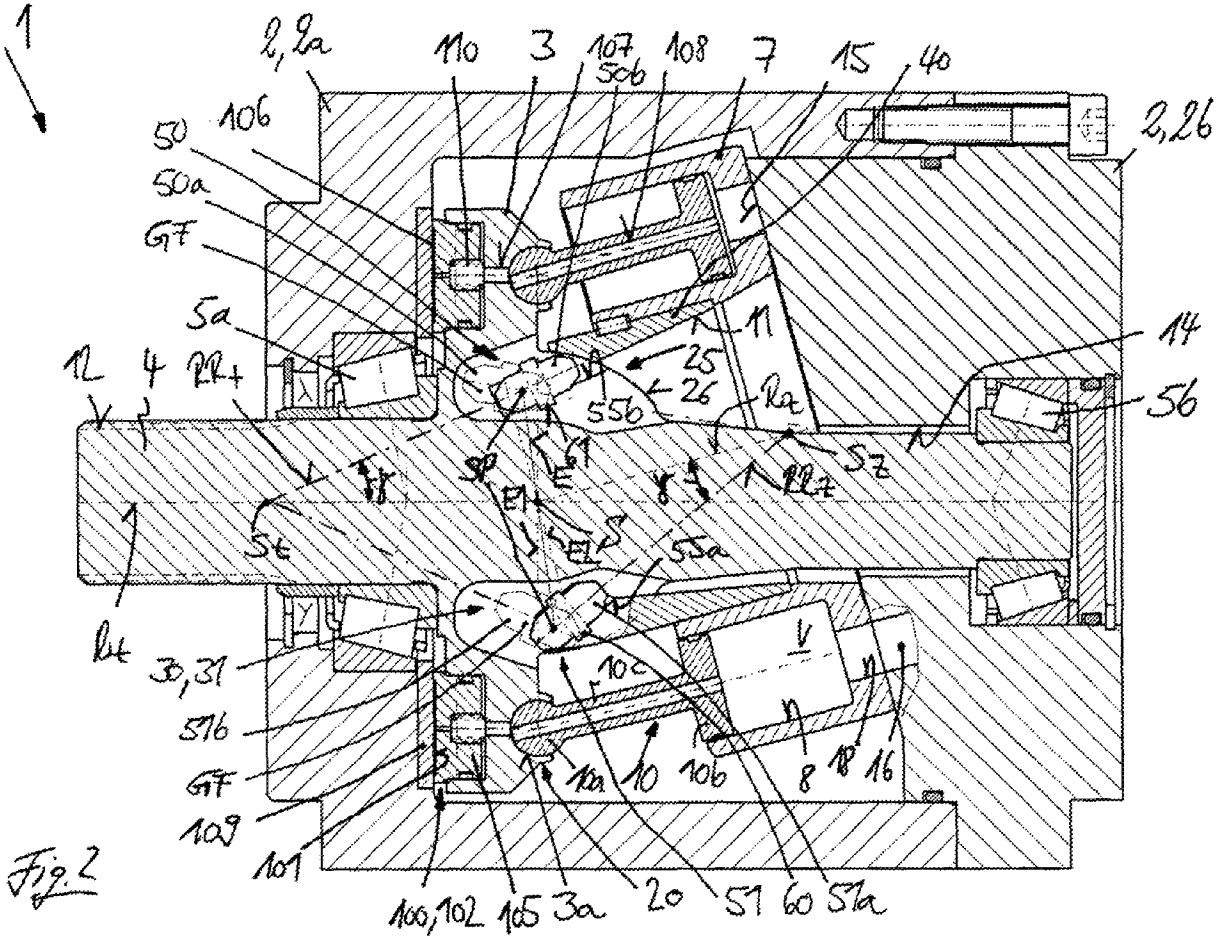
FIG. 2 is a longitudinal section through a second exemplary embodiment of an axial piston machine of the invention employing the bent-axis construction.

A hydrostatic axial piston machine 1 in the form of a band-axis machine is illustrated in FIGS. 1 and 2. The machine 1 has a housing 2 that includes a housing barrel 2*a* and a housing cover 2*b* fastened to the housing barrel 2*a*. A driveshaft 4 provided with a drive flange 3 is mounted in the housing 2 by bearing devices 5*a*, 5*b* so that it can rotate around an axis of rotation $R_t$. In the illustrated exemplary embodiment, the drive flange 3 is formed in one piece with the driveshaft 4, so that the driveshaft 4 and the drive flange 3 can be manufactured as a single part.

Located in the housing 2 axially next to the drive flange 3 is a cylinder barrel 7, which is installed so that it can rotate around an axis of rotation $R_Z$ and includes a plurality of piston bores 8, which in the illustrated exemplary embodiment are arranged concentrically around the axis of rotation $R_Z$ of the cylinder barrel 7. A longitudinally displaceable piston 10 is located in each piston bore 8.

The axis of rotation $R_t$ of the driveshaft 4 intersects the axis of rotation $R_Z$ of the cylinder barrel 7 at the intersection point S.

In the illustrated exemplary embodiment, the cylinder barrel 7 includes a central longitudinal recess 11 that is concentric to the axis of rotation $R_Z$ of the cylinder barrel 7 through which the driveshaft 4 extends. The driveshaft 4 extends longitudinally through the axial piston machine 1 and is mounted on both sides of the cylinder barrel 7 by bearing devices 5*a*, 5*b*. The driveshaft 4 is mounted with the drive flange side bearing device 5*a* in the housing barrel 2*a* and with the cylinder-barrel-side bearing device 5*b* in the housing cover 2*b*.

The driveshaft 4 is equipped on the drive flange side end with torque transmission means 12, such as splines, for the introduction of a drive torque or for the tapping of an output torque. The opposite, cylinder-barrel-side end of the driveshaft 4 that extends through the axial piston machine 1 ends in the vicinity of the housing cover 2*b*. In the housing cover 2*b*, to hold the driveshaft 4 and the bearing device 5*b*, there is a boring 14 that is concentric to the axis of rotation $R_t$ of the driveshaft 4 and, in the illustrated exemplary embodiment, is a through hole.

For control of the feed and discharge of hydraulic fluid in the displacement chambers V formed by the piston bores 8 and the pistons 10, the cylinder barrel 7 is in contact with a control surface 15, which is provided with kidney-shaped control bores that form an inlet port 16 and an outlet port of the axial piston machine 1. For connection of the displacement chambers V formed by the piston bores 8 and the pistons 10 with the control bores, the cylinder barrel 7 is provided with a control opening 18 at each piston bore 8.

The axial piston machine 1 illustrated in FIGS. 1 and 2 is in the form of a constant displacement machine with a fixed displacement volume. On a constant displacement machine, the angle of inclination $\alpha$, and thus the pivoting angle of the axis of rotation $R_Z$ of the cylinder barrel 7, is fixed and constant with respect to the axis of rotation $R_t$ of the drive flange 3 and/or the driveshaft 4. The control surface 15 with which the cylinder barrel 7 is in contact is formed on the housing 2, in the illustrated exemplary embodiment on the housing cover 2*b*, or on a control disc located non-rotationally in the housing 2.

The pistons 10 are each fastened to the drive flange 3 in an articulated manner. Between each piston 10 and the drive flange 3, there is a joint 20 in the form of a spherical joint. In the illustrated embodiment, the articulated connection is a ball joint, which is formed by a ball head 10*a* of the piston 10 and a spherical cap-shaped recess 3*a* formed in the drive flange 3 in which the piston 10 is fastened by the ball head 10*a*.

The pistons 10 each have a collar section 10*b* with which the piston 10 is positioned in the piston bore 8. A piston rod 10*c* of the piston 10 connects the collar segment 10*b* with the ball head 10*a*.

To make possible a compensating movement of the pistons 10 during rotation of the cylinder barrel 7, the collar segment 10*b* of the piston 10 is located in the piston bore 8 with at least some rim clearance. The collar segment 10*b* of the piston 10 can be spherical. To create a seal between the pistons 10 and the piston bores 8, sealing means 21, such as a piston ring, are located on the collar segment 10*b* of the piston 10.

For mounting and centering of the cylinder barrel 7, a spherical guide 25 is located between the cylinder barrel 7 and the driveshaft 4 respectively. The spherical guide 25 includes a spherical segment 26 of the driveshaft 4 on which the cylinder barrel 7 is located with a hollow spherical segment 27 located in the vicinity of the central longitudinal bore 11. The midpoint of segments 26, 27 lies at the intersection point S of the axis of rotation $R_t$ of the driveshaft 4 and the axis of rotation $R_Z$ of the cylinder barrel 7.

To achieve the drive of the cylinder barrel 7 during operation of the axial piston machine 1, a drive joint 30 is located between the driveshaft 4 and cylinder barrel 7 that couples the driveshaft 4 and the cylinder barrel 7 in the direction of rotation. The driver device is not illustrated in detail in FIG. 1 and can be any conventional device.

In FIG. 2, where identical components are identified by the same reference numbers, a drive joint 30 as the drive device is located between the driveshaft 4 and the cylinder barrel 7. In the illustrated exemplary embodiment, the drive joint is a constant velocity joint utilizing a cone-beam construction and makes possible a rotationally synchronous drive of the cylinder barrel 7 with the driveshaft 4, so that the result is a smooth, synchronous rotation of the cylinder barrel 7 with the driveshaft 4.

In the illustrated exemplary embodiment, the drive joint 30 is a constant velocity joint, such as a cone-beam half-roller joint 31.

The cone-beam half-roller joint 31 is formed by a plurality of roller pairs 50, 51 which are located between the driveshaft 4 and a sleeve-shaped driver element 40 non-rotationally connected with the cylinder barrel 7. In this case, the driveshaft 4 also extends through the drive joint 30.

Each of the plurality of roller pairs 50, 51 of the cone-beam half-roller joint 31 includes two (a pair) of semi-cylindrical half-rollers 50*a*, 50*b*, 51*a*, 51*b*. The semi-cylindrical half-rollers 50*a*, 50*b*, 51 *a*, 51*b*, are each formed by a cylindrical body flattened essentially to an axis of rotation $RR_t$, $RR_Z$. On the flattened sides, the half-rollers arranged in pairs 50*a*, 50*b*, 51*a*, 51*b* each have plane slide faces GF at which the two half-rollers 50*a*, 50*b*, 51*a*, 51*b* of a roller pair 50, 51 are in contact with each other forming a planar contact.

The half-rollers 50*a*, 50*b*, 51*a*, 51*b* are located in the radial direction inside the reference circle of the pistons 10 and at a distance from the axes of rotation $R_t$, $R_Z$. Therefore, the drive joint 30 can be located in a space-saving manner inside the reference circle of the pistons 10 and the driveshaft 4 can be located radially inside the half-rollers of the cone-beam half-roller joint 31.

Each roller pair 50, 51 has a cylinder-barrel-side half-roller 50*a*, 51*a* that corresponds to the cylinder barrel 7 and a driveshaft side half-roller 50*b*, 51*b* that corresponds to the driveshaft 4, and are in contact with each other on the flat slide faces GF.

The cylinder-barrel-side half-rollers 50*a*, 51*a* of the corresponding roller pair 50, 51 are each held in a cylindrical, or at least partly cylindrical, cylinder-barrel-side receptacle 55*a*, and the driveshaft side half-rollers 50*b*, 51*b* of a roller pair 50, 51 are held in a respective cylindrical, or at least partly cylindrical, driveshaft side receptacle 55*b*, and are secured in the respective cylindrical receptacle 55*a*, 55*b* in the longitudinal direction of the corresponding axis of rotation.

Each half-roller 50*a*, 51*a*, 50*b*, 51*b* is provided in the cylindrical segment with a collar 60 which is engaged in a groove 61 of the corresponding receptacle 55*a*, 55*b*.

In FIG. 2, the driveshaft side half-roller 50*b* of the roller pair 50 is represented by darker lines and the cylinder-barrel-side half-roller 50*a* in contact with the half-roller 50*b* is represented in fine lines. The cylinder-barrel-side half-roller 51*a* of the roller pair 51 is represented in darker lines and the driveshaft side half-roller 51*b* in contact with the half-roller 51*a* is represented in fine lines. Of the half-rollers 50*b* and 51*a*, the flattened, plane slide surfaces GF that lie in the sectional plane of FIG. 2 are shown.

On the cone-beam half-roller joint 31 as illustrated in FIG. 2, the axes of rotation $RR_t$ of the driveshaft side half-rollers 50*b*, 51*b* are inclined with respect to the axis of rotation $R_t$ of the driveshaft 4 by an angle of rotation γ. The axes of rotation $RR_t$ of the driveshaft side half-rollers 50*b*, 51*b* intersect the axis of rotation $R_t$ of the driveshaft 4 at the intersection point $S_t$. The individual axes of rotation $RR_t$ of the plurality of driveshaft side half-rollers 50*b*, 51*b* therefore form a cone beam around the axis of rotation $R_t$ of the driveshaft 4 with the tip at the intersection point $S_t$.

Accordingly, the axes of rotation $RR_z$ of the cylinder-barrel-side half-rollers 50*a*, 51*a* are inclined by an angle of inclination γ with respect to the axis of rotation $R_z$ of the cylinder barrel 7. The axes of rotation $RR_z$ of the cylinder-barrel-side half-rollers 50*a*, 51*a* intersect the axis of rotation $R_z$ of the cylinder barrel 7 at the intersection point S. The individual axes of rotation of the plurality of cylinder-barrel-side half-rollers 50*a*, 51*a* therefore form a cone beam around the axis of rotation $R_z$ of the cylinder barrel 7 with the tip at the point of intersection S.

The angles of inclination γ of the axes of rotation $RR_z$ of the cylinder-barrel-side half-rollers 50*a*, 51*a* with respect to the axis of rotation $R_z$ of the cylinder barrel 7 and the axes of rotation $RR_t$ of the driveshaft side half-rollers 50*b*, 51*b* with respect to the axis of rotation $R_t$ of the driveshaft 4 are numerically identical. The angles of inclination γ of the axes of rotation $RR_z$, $RR_t$ of the half-rollers of the driveshaft 4 and cylinder barrel 7 to be coupled with each other are therefore identical. Consequently, on the corresponding roller pairs 50, 51, each of the axes of rotation $RR_t$ corresponding to the driveshaft 4 and the axes of rotation $RR_z$ corresponding to the cylinder barrel 7 of the two half-rollers that form a roller pair intersect in pairs in a plane E that corresponds to the line bisecting the angle between the axis of rotation $R_t$ of the driveshaft 4 and the axis of rotation $R_z$ of the cylinder barrel 7. The points of intersection SP lying in the plane E at which the axes of rotation $RR_t$ corresponding to the driveshaft 4 intersect in pairs with the axes of rotation $RR_z$ corresponding to the cylinder barrel 7 of the two half-rollers that form a roller pair are illustrated in FIG. 2. The plane E is inclined at one-half the angle of inclination of the pivoting angle α/2 with reference to a plane E1 that is perpendicular to the axis of rotation $R_t$ of the driveshaft 4 and a plane E2 that is perpendicular to the axis of rotation $R_z$ of the cylinder barrel 7. The plane E runs through the point of intersection S of the axes of rotation $R_t$, $R_z$.

The half-rollers 50*a*, 50*b*, 51*a*, 51*b* of the respective roller pairs 50, 51 are located in the vicinity of the points of intersection SP of the axes of rotation $RR_t$, $RR_z$, as a result of which, at the points of intersection SP of the two half-rollers of the respective roller pairs 50, 51, the transmission of force between the plane slide faces GF takes place to drive the cylinder barrel 7.

As a result of the position of the points of intersection SP of the two half-rollers of the respective roller pairs 50, 51 in the plane E, the perpendicular and radial distances from the points of intersection SP to the axis of rotation $R_t$ of the driveshaft 4 and to the axis of rotation $R_z$ of the cylinder barrel 7 are numerically equal. On account of the equal lever arms formed by the radial distances of the points of intersection SP, the angular velocities of the driveshaft 4 and of the cylinder barrel 7 are equal, as a result of which the cone-beam half-roller joint 31 forms a constant velocity joint that makes possible a rotationally synchronous and uniform drive and rotation of the cylinder barrel 7.

In the axial piston machine 1 illustrated in FIGS. 1 and 2, for the axial mounting of the drive flange 3 on a housing-side slide face 101 of the housing 2, an axial bearing 100 is provided that is in the form of a hydrostatically relieved (balanced) sliding bearing 102. The hydrostatically relieved sliding bearing 102 comprises a plurality of slippers 105, each of which is mounted in an articulated manner so that it can move longitudinally in the drive flange 3, and is provided on an end surface facing the slide face 101 with a pressure pocket 106, which is in communication with an associated displacement chamber V of the axial piston machine 1 for the supply of hydraulic fluid. A slipper 105 is preferably associated with each piston 10.

The pressure pockets 106 in the slippers 105 are each in communication via a communication channel 107 in the drive flange 3 and a communicating channel 108 in the piston 10 with the respective displacement chamber V which is formed by the piston bore 8 and the piston 10 located in it. The housing-side slide face 101 can be created directly in the housing 2 or—as in the illustrated exemplary embodiment, on a circular bearing washer 109 which is non-rotationally fastened to the housing 2.

Figure 3:
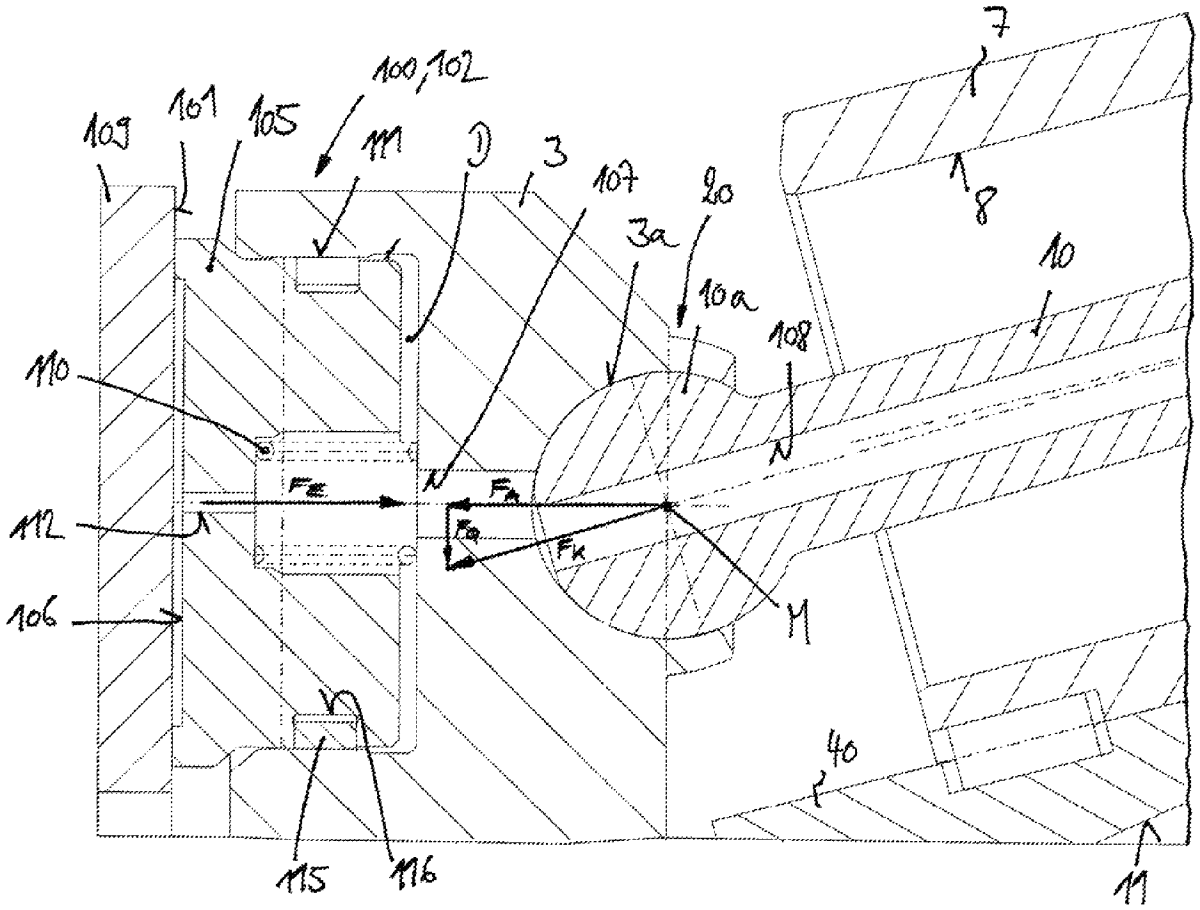
FIG. 3 is a detail of FIGS. 1 and 2 on an enlarged scale.

The function of the axial bearing 100 is to hydrostatically relieve (balance) the axial forces on the drive flange 3 that occur during operation of the axial piston machine 1. As illustrated in FIG. 3, the piston force $F_K$ present on the pressurized pistons 10, which acts in the longitudinal direction of the pistons 10, is decomposed at the center point M of the articulated connection 20 into an axial force $F_A$, which is directed parallel to the axis of rotation $R_t$ of the driveshaft 4 and of the drive flange 103, and a transverse force $F_Q$, which is oriented perpendicular to it and generates the torque. The axial force $F_A$ (and, thus, the axial force component of the piston force $F_K$) is relieved by a hydrostatic relief force $F_E$ generated by the slipper 105. As a result of this hydrostatic relief of the axial force $F_A$, the bearing devices 5*a*, 5*b* of the driveshaft 4 can be made smaller than in prior machines, so that lower mass inertia occurs in the bearing devices 5*a*, 5*b* and compact dimensions of the axial piston machine 1 can be achieved.

The slippers 105 are each pressed by a spring device 110, such as a compression spring, toward the housing-side slide face 101 and are thus pressed against the housing-side slide face 101.

The slippers 105 are each located so that they can move longitudinally in a recess 111 of the drive flange 103. In the illustrated exemplary embodiment, the recesses 111 are each formed by a receptacle boring oriented concentric to the axis of rotation $R_t$ of the driveshaft 4 and of the drive flange 103. Between the drive flange 3 and each slipper 105 there is a pressure chamber D, which is in communication via the connecting channels 107 and 108 with the displacement chamber V. Located in each slipper 105 is a respective connecting channel 112 that connects the pressure pocket 106 with the pressure chamber D and, therefore, with the associated displacement chamber V. The pressure chamber D and the pressure pocket 106 are designed so that an additional hydrostatic application force is active that presses the slipper 105 against the slide face 101.

Each slipper 105 is sealed by a sealing device 115 from the pressure chamber D. The slipper 105 is provided with a groove-shaped recess 116 in which the sealing device 115, such as an O-ring, is located.

Figure 4:
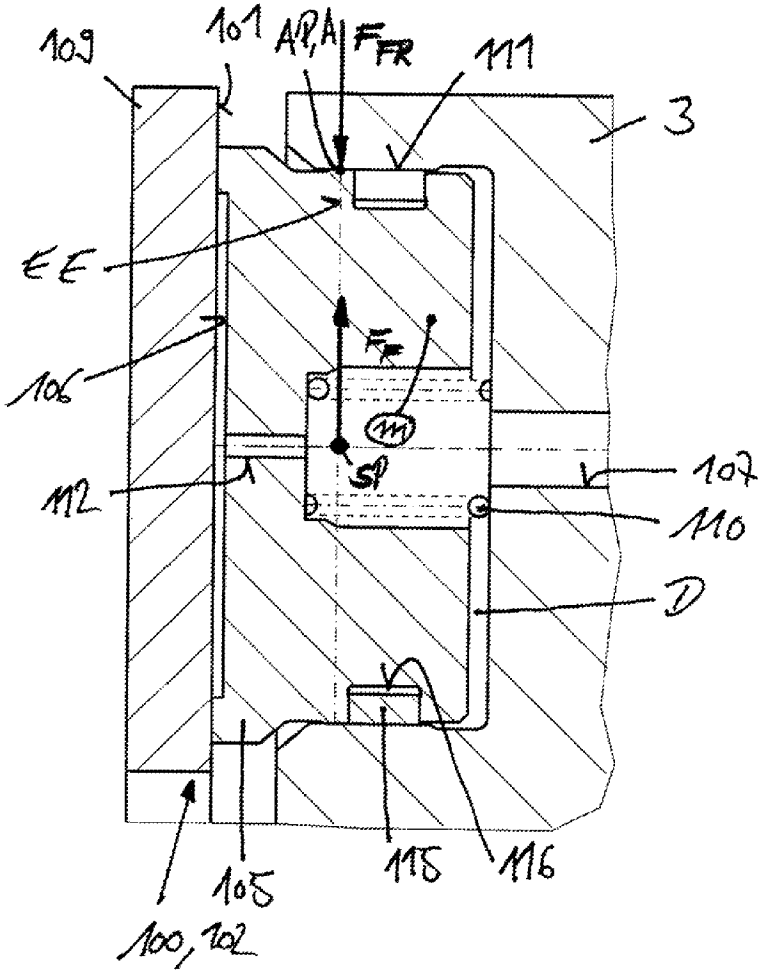
FIG. 4 is a detail of FIGS. 1 to 3 on an enlarged scale.

At high speeds of rotation of the axial piston machine 1, as illustrated in FIG. 4 the mass m of the slipper 105 results in a centrifugal force $F_F$ directed radially outwardly that is applied to the center of gravity SP of the slipper 105.

Support for the centrifugal force $F_F$ is provided by an opposite compensating force $F_{FR}$ directed radially inwardly on the drive flange 3 which, in the exemplary embodiment illustrated in FIGS. 1 to 4, lies in the vicinity of the recess 111.

To prevent a tipping of the slippers 105 away from the housing-side slide face 101 as a result of a tipping moment generated by the centrifugal force $F_F$, in the axial piston machine 1 these slippers 105 are each mounted in an articulated manner in the drive flange 103 so that the point of application AP of the compensating force $F_{FR}$ is located on the slipper 105 so that no tipping moment occurs on the slipper 105. The position of the force pair that is formed by the centrifugal force $F_F$ and the compensating force $F_{FR}$ acting in the opposite direction to each other is therefore selected according to the invention so that no tipping moment caused by centrifugal force occurs on the slipper 105.

The radial support point A of the slipper 105 in the recess 111 of the drive flange 3 on which the compensating force $F_{FR}$ is applied is located in a plane EE that is oriented perpendicularly to the axis of rotation $R_t$ of the drive flange 3 and is located in the axial direction in the vicinity of the center of gravity SP of the slipper 105. The radial support point A therefore forms the point of application AP of the compensating force $F_{FR}$. Consequently, the centrifugal force $F_F$ and the compensating force $F_{FR}$ in the opposite direction have lines of action that are aligned with each other.

The force pair formed by the centrifugal force $F_F$ and the opposite compensating force $F_{FR}$ therefore consists of forces that are directly opposite to each other, so that the centrifugal force $F_F$ and the opposite compensating force $F_{FR}$ have no lever anus on the support point A of the slipper 105 in the recess 111 and, therefore, no tipping moment caused by centrifugal force occurs on the slippers 105.

Figure 5:
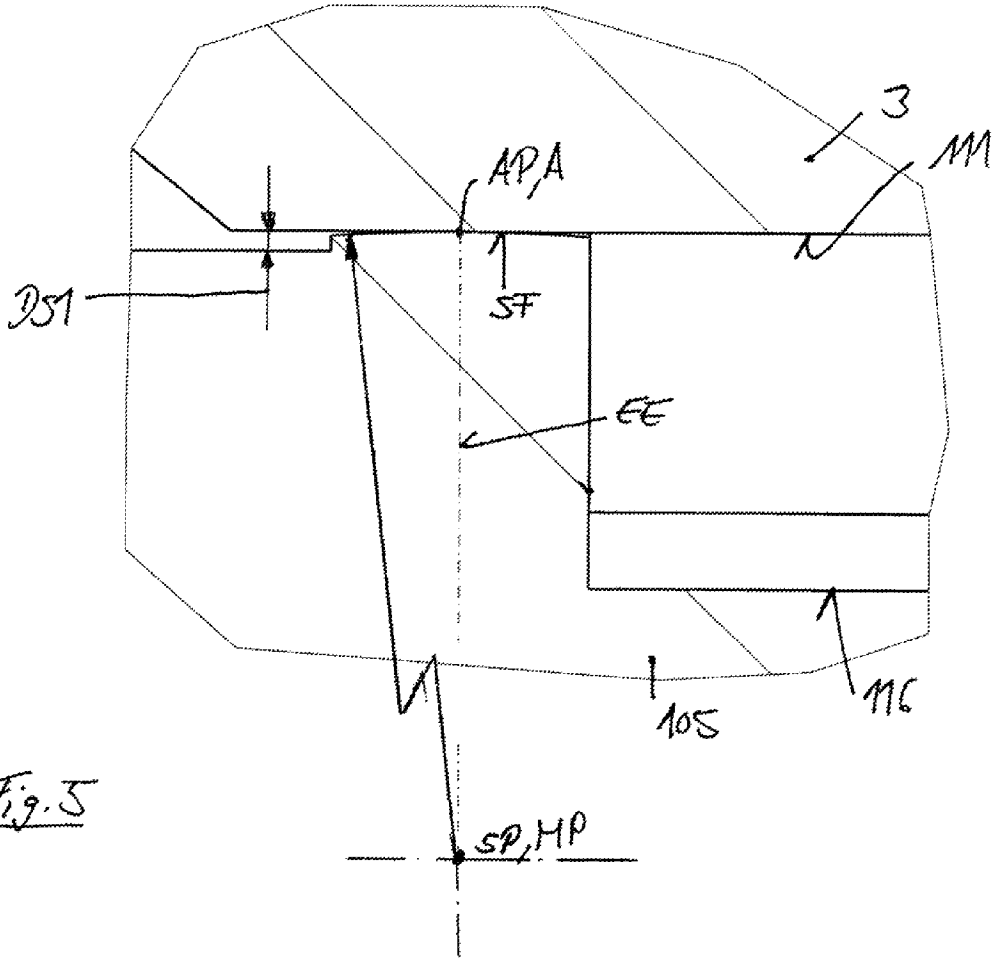
FIG. 5 is a detail of FIG. 4 on an enlarged scale.

To achieve the articulated mounting of the longitudinally displaceable slipper 105 in the recess 111 of the drive flange 103, the slipper 105, as illustrated in FIG. 5, is located with a rim diametric clearance DS1 in the recess 111 of the drive flange 103 and a diametric widening in the area in which the support point A is located.

Figure 7:
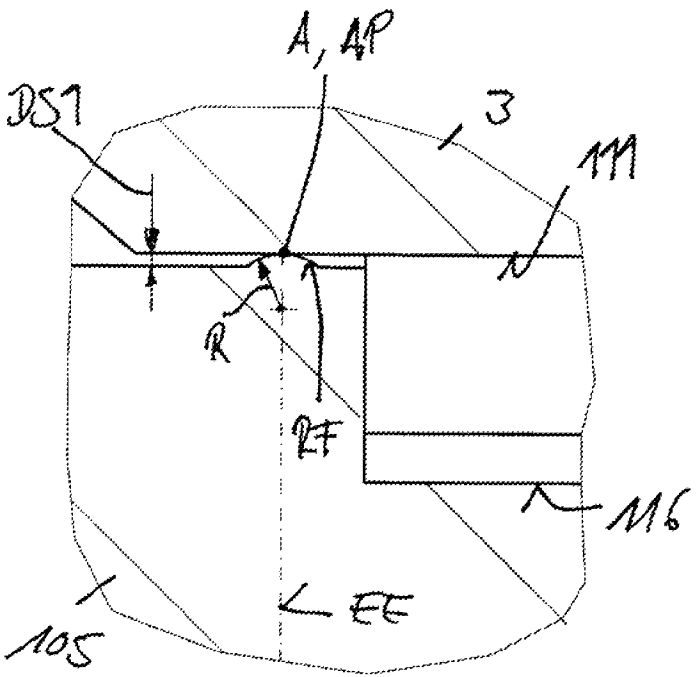
FIG. 7 shows an additional exemplary embodiment of the invention in an illustration like the one in FIG. 5.
Figure 6:
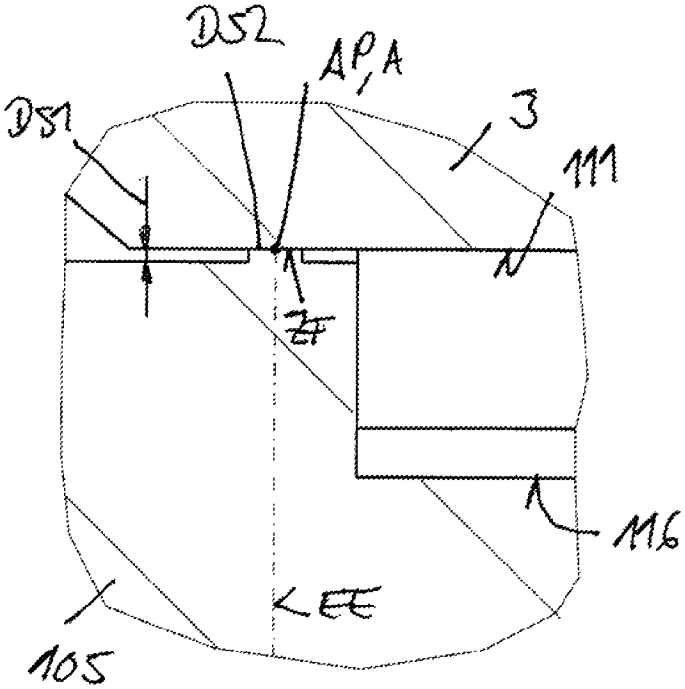
FIG. 6 shows an additional exemplary embodiment of the invention in an illustration like the one in FIG. 5.

FIGS. 5 to 7 illustrate on a larger scale the areas in FIGS. 1 to 4 in which the support point A and the plane EE are located. In the exemplary embodiment illustrated in FIGS. 1 to 5, the radial outer area of the wider-diameter portion is in the form of a spherical surface SF on the slipper 105 that is located inside the recess 111. The midpoint MP of the spherical surface SF lies in the center of gravity SP of the slipper 105. The spherical surface SF guarantees an articulated mounting of the slipper 105 in the recess 111 that guarantees an effective compensation for tipping forces exerted on the slipper 105.

FIGS. 6 and 7 illustrate alternative embodiments that can be used with the axial piston machine 1.

As illustrated in FIG. 6, the radially outer area of the wider-diameter portion of the slipper 105 in the vicinity of the plane EE (and thus in the vicinity of the support point A) is in the form of a cylindrical surface ZF, the generated surface of which is concentric with the longitudinal axis of the slipper 105. To prevent tipping of the slipper 105 in the recess 111, a rim diametric clearance DS2 is provided between the cylindrical surface ZF and the recess 111 of the drive flange 3. The rim diametric clearance DS2 is less than the rim diametric clearance DS1 in the other areas of the slipper 105.

As illustrated in FIG. 7, the radial outer area of the wider-diameter portion is in the form of an annular area RF of the slipper 105 in the vicinity of the plane EE (and thus in the vicinity of the support point A). The annular area in the form of an annular area RF has a radius R, the foot of which is located on the plane EE and at a radial distance from the center of gravity SP of the slipper 105.

Figure 8:
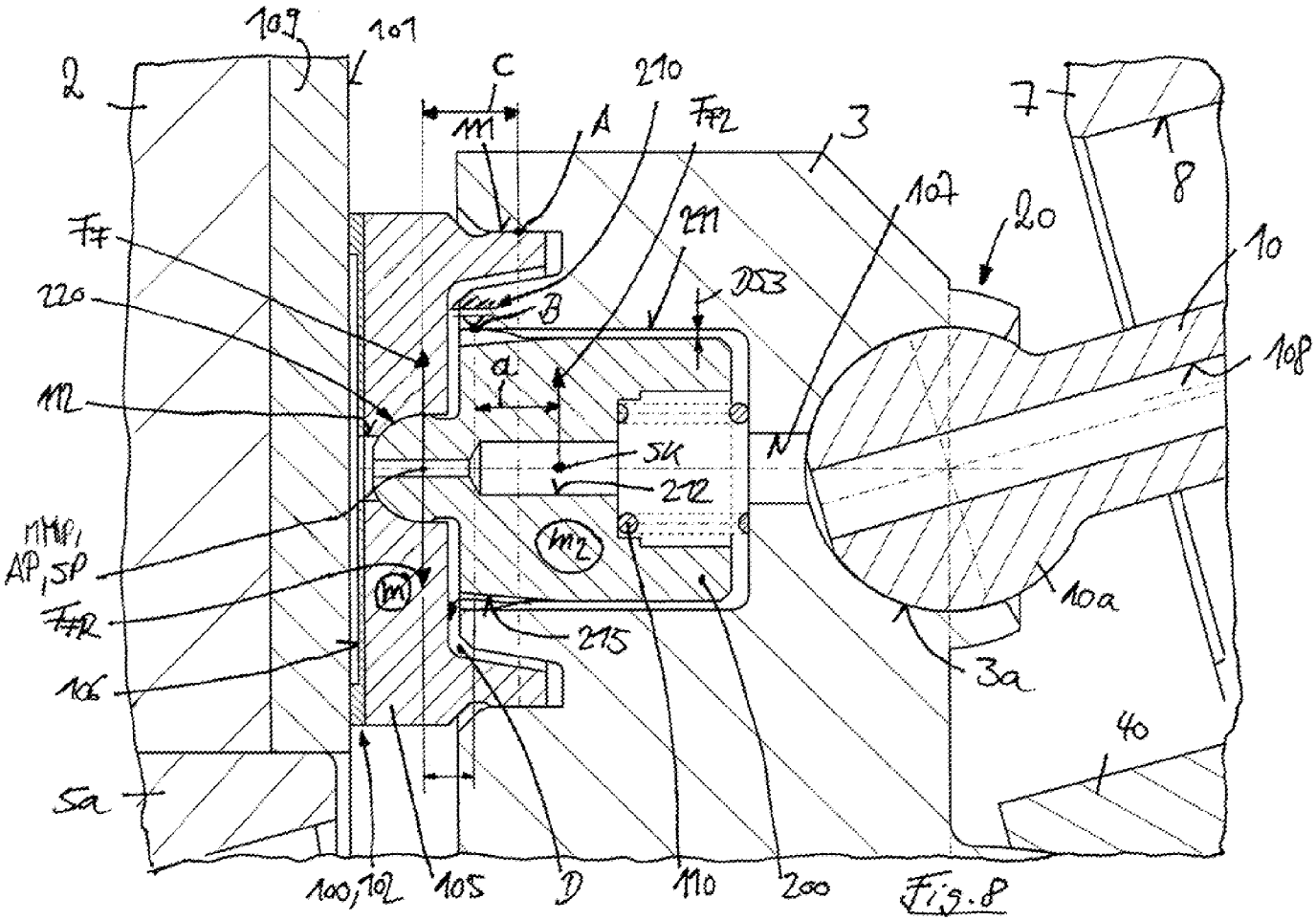
FIG. 8 shows an additional exemplary embodiment of the invention.

FIG. 8 illustrates an additional embodiment of an axial piston machine 1 utilizing the bent-axis construction, in which identical components are identified by the same reference numbers.

In the exemplary embodiment illustrated in FIG. 8, the slippers 105 are each mounted in the drive flange 103 in an articulated manner and can move longitudinally so that when the drive flange 103 is in rotation, a compensating force $F_{FR}$ acts on the slipper 105 which is directed opposite to the centrifugal force $F_F$ acting on the slipper 105. The point of application AP of the compensating force $F_{FR}$ on the slipper 105 is selected to provide total or partial compensation for a tipping moment on the slipper 105 caused by centrifugal force.

Each slipper 105 is in an operative connection with an additional compensating body 200 that fully or partly compensates for a tipping moment on the slipper 105 caused by the centrifugal force $F_F$.

The compensating body 200 generates the compensating force $F_{FR}$ that acts on the slipper 105, and is in the opposite direction to the centrifugal force $F_F$ acting on the slipper 105. The point of application AP of the compensating force $F_{FR}$ generated by the compensating body 200 and acting on the slipper 105 lies in the center of gravity SP of the slipper 105.

The radial support point A of the slipper 105 in the recess 111 of the drive flange 3 is kept at a distance in the axial direction from the center of gravity SP of the slipper 105 by a first lever arm c.

The compensating body 200 is mounted on the drive flange 103 by the articulated joint 210 in an articulated manner and is in an operative connection with the slipper 105 in the center of gravity SP. The compensating force $F_{FR}$ is generated by the centrifugal force $F_{F2}$ acting on the compensating body 200.

In the illustrated exemplary embodiment, the compensating body 200 is coaxial with the slipper 105, is mounted in an articulated manner, and is longitudinally movable within the radial dimensions of the slipper 105 in the drive flange 3.

The drive flange 3 is provided with an additional recess 211 in which the compensating body 200 is mounted in an articulated manner and so that it can move longitudinally. The additional recess 211 is coaxial with the recess 111 for the slipper 105 and has a smaller diameter than that of the recess 111.

The additional recess 211 is in communication via the connecting channel 107 in the drive flange 3 and the connecting channel 108 in the piston 10 with the displacement chamber V. The compensating body 200 is provided with a connecting channel 212, by means of which the pressure pocket 106 of the slipper 105 is in communication with the displacement chamber V.

In the illustrated exemplary embodiment, the compensating body 200 is connected with the slipper 105 by a ball joint 220, the midpoint MMP of which is located in the center of gravity SP of the slipper 105. The ball joint 220 in the illustrated exemplary embodiment is formed by a ball head on a journal-shaped segment of the compensating body 200 and a recess in the form of a spherical cap in the slipper 105.

For articulated installation of the compensating body 200 in the recess 211, which can move longitudinally in the recess 211, the compensating body 200 is located with a rim diametric clearance DS3 in the recess 211, and the articulated joint 210 is formed by a wider-diameter portion of the compensating body 200. In the illustrated exemplary embodiment, the radially outer area of the compensating body 200 in the vicinity of the wider-diameter portion is an annular area analogous to FIG. 7. The radial outer surface of the compensating body 200 in the vicinity of the expanded diameter can alternatively be designed analogous to FIGS. 5 and 6. The articulated joint 210 forms a radial support point B, with which the compensating body 200 is supported in the recess 211. The articulated joint 210, and thus, the support point B of the compensating body 200 on the drive flange 3, is located in the axial direction between the center of gravity SP of the slipper 105 and the center of gravity SK of the compensating body 200. The center of gravity SK of the compensating body 200 is kept at a distance from the articulated connection 210 and, thus, from the support point B, by the lever arm a.

In the exemplary embodiment illustrated in FIG. 8, the spring device 110 is located in the recess 211 and applies pressure to the compensating body 200, which is in an operative connection with the slipper 105. Alternatively the spring device 110 can be located in the recess 111 and can apply pressure to the slipper 105 directly.

The pressure chamber D that applies pressure to the slipper 105 is located between the slipper 105, the recess 111, and the compensating body 200. To achieve communication of the compression chamber D with the displacement chamber V, in the vicinity of the articulated connection 210 of the compensating body 200 there is at least one recess 215. The pressure chamber D is therefore in communication via the recess 215 and the rim diametric clearance DS3 of the compensating body 200 with the connecting channel 107.

To achieve articulated mounting of the slipper 105 in the recess 111, and thus, to make it possible to control the tipping of the slipper 105 in the recess 111, the slipper 105 in FIG. 8 is provided analogous to FIG. 7 with a cylindrical outer area, whereby tipping is controlled by a corresponding rim diametric clearance. Between the cylindrical outer area of the slipper 105 and the recess, there is a relatively short guide length, so that in connection with an appropriately dimensioned rim diametric clearance, the control of the tipping of the slipper 105 becomes possible. Alternatively, the slipper 105 can be mounted in the recess 111 of the drive flange analogous to FIGS. 5 and 6.

In FIG. 8, without compensation measures, the centrifugal force $F_F$ would be supported at the support point A and with the lever arm c between the center of gravity SP of the slipper 105 on which the centrifugal force $F_F$ is applied and the support point A of the slipper 105 in the recess 111, a tipping moment of the slipper 105 caused by centrifugal force would occur, which would cause the slipper 105 to tip away from the housing-side slide face 101. Compensation for some or all of this tipping moment caused by centrifugal force can be provided by the additional compensating bodies 200. The additional compensating body 200 applies the compensating force $F_{FR}$ in the direction opposite to the centrifugal force $F_F$ in the center of gravity SP of the slipper 105.

The compensating force $F_{FR}$ results from the centrifugal force $F_{F2}$ directed radially outwardly of the compensating body 200, which originates from the mass $m_2$ of the compensating body 200, and is applied at the center of gravity SK of the compensating body 200, in connection with the reversal of the direction of force radially inwardly by, the selection of the support point B.

In the exemplary embodiment illustrated in FIG. 8, the mass $m_2$ of the compensating body 200, of the first lever arm c, and of the second lever arm a, are designed so that the compensating force $F_{FR}$ generated by the compensating body 200 is essentially of the same magnitude as the centrifugal force $F_F$ acting on the slipper 105. Consequently, compensation for the tipping moment of the slipper 105 can be provided by means of the additional compensating body 200 and a tipping of the slipper 105 away from the housing-side slide face 101 at high rotational speeds can be prevented.

The invention is not limited to the exemplary embodiments illustrated and/or described above.

In FIGS. 1 to 7, as a result of the position of the support point A in the plane EE that runs through the center of gravity SP, there is no tipping moment on the slipper 105. It goes without saying that the plane EE in which the support point A is located can be at a slight distance in the axial direction from the center of gravity SP, so that there is only a partial compensation of the tipping moment. As a result of this position of the plane EE, a short lever arm in the axial direction occurs between the force pair formed by the centrifugal force $F_F$ and the compensating force $F_{FR}$, which can be tolerated with a corresponding sizing of the force applied by the spring 110 and the hydrostatic relief.

The selection of the hydrostatic relief by the slipper 105 can be made so that the hydrostatic relief force $F_E$ equals the axial force $F_A$, so that exact compensation can be provided for the axial force $F_A$. This design can be incorporated in an axial piston machine in the form of a constant displacement machine with a constant displacement volume.

Alternatively, the hydrostatic relief force $F_E$ can be less than the axial force $F_A$, so that the remaining differential of the axial force from these two forces is absorbed by the drive-flange-side bearing device 5*a*.

Alternatively, the hydrostatic relief force $F_E$ can be greater than the axial force $F_A$, so that the remaining differential of the axial force from these two forces is absorbed by the cylinder-barrel-side bearing device 5*b*.

Instead of in the form of a constant displacement machine, the axial piston machine 1 can be constructed as a variable displacement machine with a variable displacement volume. In a variable displacement machine, the angle of inclination $\alpha$ (and thus the pivoting angle of the axis of rotation $R_Z$ of the cylinder barrel 7) is variable with respect to the axis of rotation $R_t$ of the driveshaft 4 for variation of the displacement volume. The control surface 15 with which the cylinder barrel 7 is in contact is for this purpose located on a cradle body, which is located in the housing 2 so that it can pivot around a pivoting axis that lies in the point of intersection S of the axis of rotation $R_t$ of the driveshaft 4 and the axis of rotation $R_Z$ of the cylinder barrel 7 and is oriented perpendicular to the axes of rotation $R_t$ and $R_Z$. Depending on the position of the cradle body, the angle of inclination (and thus the pivoting angle $\alpha$ of the axis of rotation $R_Z$ of the cylinder barrel 7) varies with respect to the axis of rotation $R_t$ of the driveshaft 4. The cylinder barrel 7 can be pivoted into a null position in which the axis of rotation $R_Z$ of the cylinder barrel 7 is coaxial with the axis of rotation $R_t$ of the driveshaft 4. Starting from this null position, the cylinder barrel can be pivoted to one or both sides, so that the axial piston machine can be constructed in the form of a unilaterally pivotable or as a bilaterally pivotable variable displacement machine.

In a variable displacement machine in which the displacement volume is varied by varying the pivoting angle $\alpha$, the axial force $F_A$ varies as a result of the splitting of the force in the articulated joint 20. In the event of a reduction of the displacement volume by a reduction of the pivoting angle $\alpha$, the axial force $F_A$ increases. The selection among the above-mentioned three cases for the design of the hydrostatic relief force $F_E$ can therefore be made as a function of the selection of the hydrostatic relief force $F_E$ in the range of the pivoting angle of a variable displacement machine.

It goes without saying that the driver element 40 can be constructed in one piece with the cylinder barrel 7.

Instead of the driveshaft 4 that extends through the cylinder barrel 7 and is supported on bearings on both sides in the housing, the driveshaft 4 provided with the drive flange 3 can be supported by two bearing devices and cantilevered in the housing 2.

It will be readily appreciated by those skilled in the art that modifications may be made to the invention without departing from the concepts disclosed in the foregoing description. Accordingly, the particular embodiments described in detail here are illustrative only and are not limiting to the scope of the invention, which is to be given the full breadth of the appended claims and any and all equivalents thereof.

The invention claimed is:

1. A hydrostatic axial piston machine utilizing a bent-axis construction, comprising:

a driveshaft with a drive flange rotatable around an axis of rotation inside a housing;

a cylinder barrel located inside the housing and rotatable around an axis of rotation, wherein the cylinder barrel includes a plurality of piston bores;

a longitudinally displaceable piston located in each piston bore, wherein the pistons are fastened in an articulated manner to the drive flange, and wherein the drive flange is supported on a housing-side slide face by an axial bearing comprising a hydrostatically relieved sliding bearing having a plurality of slippers, each of which is mounted in an articulated manner in the drive flange and includes a pressure pocket on an end surface facing the slide face wherein the pressure pocket is in communication with an associated displacement chamber of the axial piston machine, wherein each of the slippers is mounted in an articulated manner in the drive flange so that when the drive flange rotates, a compensating force acts on the slipper which is in an opposite direction to the centrifugal force acting on the slipper, wherein a point of application of the compensating force on the slipper is selected so as to reduce or eliminate a tipping moment on the slipper or to compensate for some or all of the tipping moment that does occur, and a spring device that presses the slipper toward the housing-side slide face.

2. The hydrostatic axial piston machine as recited in claim 1, wherein a point of application of the compensating force in an axial direction lies at a level of a center of gravity of the slipper.

3. The hydrostatic axial piston machine as recited in claim 1, wherein the slipper is mounted in an articulated manner in a recess of the drive flange, wherein the radial support point of the slipper in the recess of the drive flange corresponds to a point of application of the compensating force.

4. The hydrostatic axial piston machine as recited in claim 1, wherein a radial support point of the slipper in the recess of the drive flange lies in a plane that is oriented perpendicular to the axis of rotation of the drive flange and is located in an axial direction in a vicinity of a center of gravity of the slipper.

5. The hydrostatic axial piston machine as recited in claim 1, wherein the slipper is mounted in an articulated manner in a recess of the drive flange, wherein a radial support point of the slipper in the recess of the drive flange is at a distance in an axial direction from a point of application of the compensating force.

6. The hydrostatic axial piston machine as recited in claim 1, wherein the slipper is in an operative connection with a compensating body that compensates in whole or in part for a tipping moment on the slipper caused by centrifugal force.

7. The hydrostatic axial piston machine as recited in claim 6, wherein the compensating body generates the compensating force that acts on the slipper and is in an opposite direction to the centrifugal force on the slipper, wherein a point of application of a compensating force generated by the compensating body and acting on the slipper lies in a vicinity of a center of gravity of the slipper.

8. The hydrostatic axial piston machine as recited in claim 6, wherein a radial support point of the slipper in the recess of the drive flange is kept at a distance in an axial direction of the center of gravity of the slipper by a first lever arm.

9. The hydrostatic axial piston machine as recited in claim 6, wherein the compensating body is mounted in an articulated manner on the drive flange by an articulated connection and is in an operative connection with the slipper in an axial direction in a vicinity of a center of gravity of the slipper, wherein the compensating force is generated by centrifugal force acting on the compensating body.

10. The hydrostatic axial piston machine as recited in claim 9, wherein the articulated connection of the compensating body on the drive flange is located in an axial direction between a center of gravity of the slipper and the center of gravity of the compensating body.

11. A hydrostatic axial piston machine as recited in claim 9, wherein the articulated connection of the compensating body with the drive flange is kept at a distance from the center of gravity of the compensating body by a second lever arm, wherein a mass of the compensating body, of the first lever arm, and of the second lever arm, are configured so that the compensating force generated by the compensating body is of a same magnitude as the centrifugal force acting on the slipper.

12. The hydrostatic axial piston machine as recited in claim 9, wherein at least one recess is located in a vicinity of the articulated connection of the compensating body, and wherein a pressure chamber is in communication with the displacement chamber by the at least one recess.

13. The hydrostatic axial piston machine as recited in claim 6, wherein the compensating body is coaxial with the slipper and is located inside the radial dimensions of the slipper in the drive flange.

14. The hydrostatic axial piston machine as recited in claim 13, wherein the drive flange includes an additional recess, in which the compensating body is mounted in an articulated manner, wherein the additional recess is coaxial with the recess for the slipper.

15. The hydrostatic axial piston machine as recited in claim 14, wherein the additional recess is in an operative connection with the displacement chamber and the compensating body includes a connecting channel, by means of which the pressure pocket of the slipper is in communication with the displacement chamber.

16. The hydrostatic axial piston machine as recited in claim 1, wherein a pressure chamber is located between the drive flange and the slipper, wherein the pressure chamber is in communication with the displacement chamber.

17. The hydrostatic axial piston machine as recited in claim 16, wherein the slipper is sealed to the pressure chamber by a sealing device.

18. The hydrostatic axial piston machine as recited in claim 17, wherein the slipper includes a groove-shaped recess in which the sealing device is located.

19. The hydrostatic axial piston machine as recited in claim 1, wherein the drive flange is one piece with the driveshaft.

20. The hydrostatic axial piston machine as recited in claim 1, wherein the slipper is located with a rim diametric clearance in the recess of the drive flange.

21. The hydrostatic axial piston machine as recited in claim 20, wherein the slipper includes a wider-diameter portion in a vicinity of a radial support point.

22. The hydrostatic axial piston machine as recited in claim 21, wherein a radially outer area of the wider-diameter portion is a spherical surface area, the midpoint of which lies in a center of gravity of the slipper.

23. The hydrostatic axial piston machine as recited in claim 21, wherein a radially outer area of the wider-diameter portion is an annular area.

24. The hydrostatic axial piston machine as recited in claim 21, wherein a radially outer area of the wider-diameter portion is a cylindrical surface area, wherein there is a rim diametric clearance between the cylindrical surface area and the recess of the drive flange.

* * * * *